US008231074B2

(12) United States Patent
Hu et al.

(10) Patent No.: US 8,231,074 B2
(45) Date of Patent: Jul. 31, 2012

(54) LACE WINDING DEVICE FOR SHOES

(76) Inventors: Rong-Fu Hu, Wuri Township, Taichung County (TW); Jin-Jia Hu, Wuri Township, Taichung County (TW)

( * ) Notice: Subject to any disclaimer, the term of this patent is extended or adjusted under 35 U.S.C. 154(b) by 15 days.

(21) Appl. No.: 12/797,774

(22) Filed: Jun. 10, 2010

(65) Prior Publication Data

US 2011/0303782 A1 Dec. 15, 2011

(51) Int. Cl.
*B65H 75/38* (2006.01)

(52) U.S. Cl. ..... 242/388.1; 242/388.2; 242/388.3; 242/396.4; 24/68 SK

(58) Field of Classification Search .... 242/378.1–378.3, 242/388.1–388.3, 395, 396.4; 24/68 R, 68 SK
See application file for complete search history.

(56) References Cited

U.S. PATENT DOCUMENTS

| | | | | |
|---|---|---|---|---|
| 4,633,599 | A * | 1/1987 | Morell et al. | 242/388.1 |
| 4,660,300 | A * | 4/1987 | Morell et al. | 36/118.1 |
| 7,367,522 | B2 * | 5/2008 | Chen | 242/378.1 |
| 2005/0098673 | A1 * | 5/2005 | Huang | 242/395 |
| 2007/0084956 | A1 * | 4/2007 | Chen | 242/388.6 |

* cited by examiner

*Primary Examiner* — Sang Kim
(74) *Attorney, Agent, or Firm* — Alan Kamrath; Kamrath IP Lawfirm, PA

(57) ABSTRACT

A lace winding device includes a base, a spool rotatably mounted in the base, a lace having two distal ends each extending through the base and each secured on the spool, a limit barrel mounted on the base, a drive member rotatably mounted in the limit barrel and connected with the spool to rotate the spool, and a ratchet block movably mounted on the limit barrel and engaging the drive member. Thus, the drive member is rotated in one direction only by limit of the ratchet block so that the spool is driven by the drive member to rotate in the positive direction only and cannot be rotated in the opposite direction so as to wind the lace easily and quickly.

15 Claims, 9 Drawing Sheets

LACE WINDING DEVICE FOR SHOES

BACKGROUND OF THE INVENTION

1. Field of the Invention

The present invention relates to a winding device and, more particularly, to a winding device for winding and unwinding a lace of shoes, boots and the like.

2. Description of the Related Art

A conventional lace is mounted on shoes so that a user can tighten the lace so as to fix the shoes. However, the user has to tie or untie the lace for tightening or loosening the shoes, thereby causing inconvenience to the user. In addition, the lace depends from the shoes, thereby decreasing the aesthetic quality of the shoes.

BRIEF SUMMARY OF THE INVENTION

The primary objective of the present invention is to provide a lace winding device that is operated in one direction only so as to wind the lace smoothly and stably.

In accordance with the present invention, there is provided a lace winding device, comprising a base, a spool rotatably mounted in the base, a lace having two distal ends each extending through the base and each secured on the spool to move in concert with the spool, a limit barrel mounted on the base, a drive member rotatably mounted in the limit barrel and connected with the spool to drive and rotate the spool, a ratchet block movably mounted on the limit barrel and engaging the drive member to limit the drive member to rotate in a oneway manner, and an elastic member mounted on the limit barrel and abutting the ratchet block to press the ratchet block toward the limit barrel.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
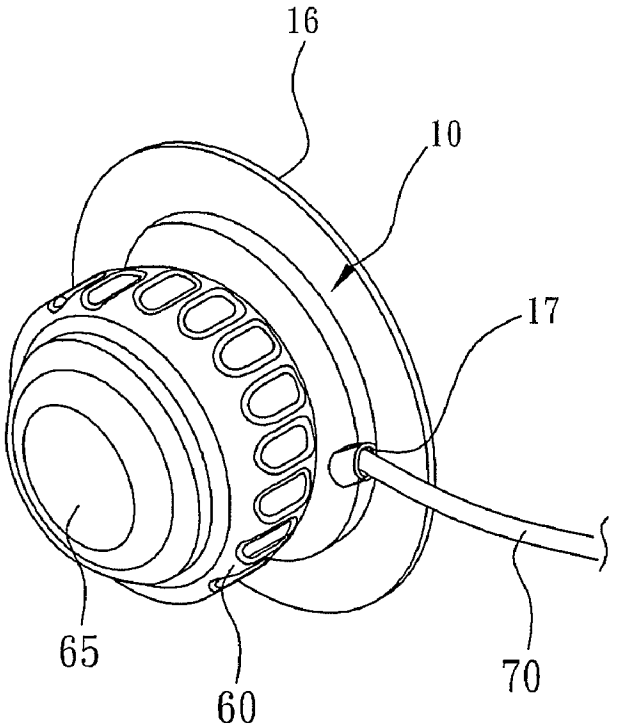
FIG. 1 is a perspective view of a lace winding device in accordance with the preferred embodiment of the present invention.

Referring to the drawings and initially to FIGS. 1-5, a lace winding device in accordance with the preferred embodiment of the present invention comprises a base 10, a spool 20 rotatably mounted in the base 10, a lace 70 having two distal ends 72 each extending through the base 10 and each secured on the spool 20 to move in concert with the spool 20, a limit barrel 40 mounted on the base 10, a drive member 50 rotatably mounted in the limit barrel 40 and connected with the spool 20 to drive and rotate the spool 20, a ratchet block 45 movably mounted on the limit barrel 40 and engaging the drive member 50 to limit the drive member 50 to rotate in a oneway manner, an elastic member 47 mounted on the limit barrel 40 and abutting the ratchet block 45 to press the ratchet block 45 toward the limit barrel 40, an end cap 30 mounted on the base 10 and abutting the spool 20 to cover the spool 20, a control knob 60 rotatably mounted on the limit barrel 40 and connected with the drive member 50 to move the drive member 50, and a decorative cap mounted on the control knob 60.

The base 10 has an inner portion formed with a receiving chamber 11 to receive the spool 20 and has a peripheral wall formed with two passages 17 each connected to the receiving chamber 11 to allow passage of each of the two distal ends 72 of the lace 70. The base 10 has an end face formed with a mounting hole 12 connected to the receiving chamber 11. The mounting hole 12 of the base 10 is co-axial with and has a diameter smaller than that of the receiving chamber 11. The base 10 has an outer wall provided with an enlarged mounting ring 16 which extends radially and outwardly. The mounting ring 16 of the base 10 has a side formed with two locking grooves 14. The passages 17 of the base 10 are formed radially in a peripheral wall of the mounting ring 16. The base 10 has a side provided with an outer threaded portion 15. The end face of the base 10 has a periphery formed with two fixing bores 13 each connected to the receiving chamber 11. The receiving chamber 11 of the base 10 is closed by the end cap 30.

The spool 20 is rotatably mounted in the receiving chamber 11 of the base 10 and is disposed between the base 10 and the end cap 30. The spool 20 has an outer wall formed with a recessed winding zone 21 connected to the receiving chamber 11 of the base 10 to wind and unwind the lace 70 by rotation of the spool 20. The winding zone 21 of the spool 20 has a peripheral wall formed with two tie holes 22 aligning with the two passages 17 of the base 10 to allow entrance of the two distal ends 72 of the lace 70. The spool 20 has an inner wall formed with a plurality of keyways 25. The spool 20 has a first side provided with a protruding mounting portion 26 rotatably mounted in the mounting hole 12 of the base 10. The first side of the spool 20 has a periphery formed with two screw bores 23 connected to the two tie holes 22 and aligning with the two fixing bores 13 of the base 10. The keyways 25 of the spool 20 are disposed in the mounting portion 26. The spool 20 has a second side provided with a protruding pivot portion 24.

The lace 70 is mounted in the winding zone 21 of the spool 20. The two distal ends 72 of the lace 70 extend through the two passages 17 of the base 10, the receiving chamber 11 of the base 10 and the winding zone 21 of the spool 20 into the two tie holes 22 of the spool 20, and the lace winding device further comprises two screw members 230 extending through the two fixing bores 13 of the base 10 and screwed into the two screw bores 23 of the spool 20 to press the two distal ends 72 of the lace 70 so as to lock the two distal ends 72 of the lace 70 onto the spool 20.

The end cap 30 has a central portion provided with a recessed pivot section 32 mounted on the pivot portion 24 of the spool 20 so that the pivot portion 24 of the spool 20 is rotatable by support of the pivot section 32 of the end cap 30. The end cap 30 has a side provided with an inner threaded portion 31 screwed onto the outer threaded portion 15 of the base 10 to lock the end cap 30 onto the base 10.

The limit barrel 40 has an inner portion formed with a receiving space 41 to receive the drive member 50 and has a peripheral wall formed with a receiving recess 44 connected to the receiving space 41 to receive the ratchet block 45. The limit barrel 40 has an end face formed with a through hole 42 connected to the receiving space 41. The through hole 42 of the limit barrel 40 is co-axial with and has a diameter smaller than that of the receiving space 41. The limit barrel 40 has an outer wall formed with an annular retaining groove 46 connected to the receiving recess 44 to receive the elastic member 47. The limit barrel 40 has a side provided with two flexible locking pieces 43 snapped into and locked in the locking grooves 14 of the mounting ring 16 to lock the limit barrel 40 onto the base 10.

The ratchet block 45 is movably mounted in the receiving recess 44 of the limit barrel 40 and has a distal end provided with an oblique locking detent 450 extending into the receiving space 41 of the limit barrel 40 and engaging the drive member 50.

The drive member 50 is rotatably mounted in the receiving space 41 of the limit barrel 40 and is disposed between the limit barrel 40 and the base 10. The drive member 50 has a mediate portion provided with a ratchet wheel 51 engaging the locking detent 450 of the ratchet block 45. The ratchet wheel 51 of the drive member 50 is limited by the locking detent 450 of the ratchet block 45 so that the ratchet wheel 51 of the drive member 50 is rotatable in the receiving space 41 of the limit barrel 40 in one direction only. The drive member 50 has a first side provided with a plurality of keys 52 engaging the keyways 25 of the spool 20. The drive member 50 has a second side provided with a shaft 53 protruding outward from the limit barrel 40. The shaft 53 of the drive member 50 is rotatably mounted in the through hole 42 of the limit barrel 40. The shaft 53 of the drive member 50 has a distal end provided with a plug 54 protruding outward from the through hole 42 of the limit barrel 40.

When in use, the drive member 50 is movable axially in the receiving space 41 of the limit barrel 40 and is movable axially relative to the spool 20 between a first position where the keys 52 of the drive member 50 engage the keyways 25 of the spool 20 so that the drive member 50 is combined with the spool 20, and a second position where the keys 52 of the drive member 50 disengage the keyways 25 of the spool 20 so that the drive member 50 is detached from the spool 20.

The elastic member 47 has a substantially C-shaped profile and abuts an outer periphery to press the locking detent 450 of the ratchet block 45 toward the ratchet wheel 51 of the drive member 50.

The control knob 60 has an inner portion formed with a sliding recess 61 rotatably mounted on the limit barrel 40. The sliding recess 61 of the control knob 60 is movable axially on the limit barrel 40 and has a bottom wall formed with a fixing slot 62 secured on the plug 54 of the drive member 50 to combine the control knob 60 with the drive member 50 so that the drive member 50 is rotatable in concert with the control knob 60. The control knob 60 has an end face formed with a through bore 63 connected to the fixing slot 62, and the lace winding device further comprises a fastening bolt 64 extending through the through bore 63 of the control knob 60 and screwed into the plug 54 of the drive member 50 to fasten the control knob 60 with the drive member 50.

Figure 2:
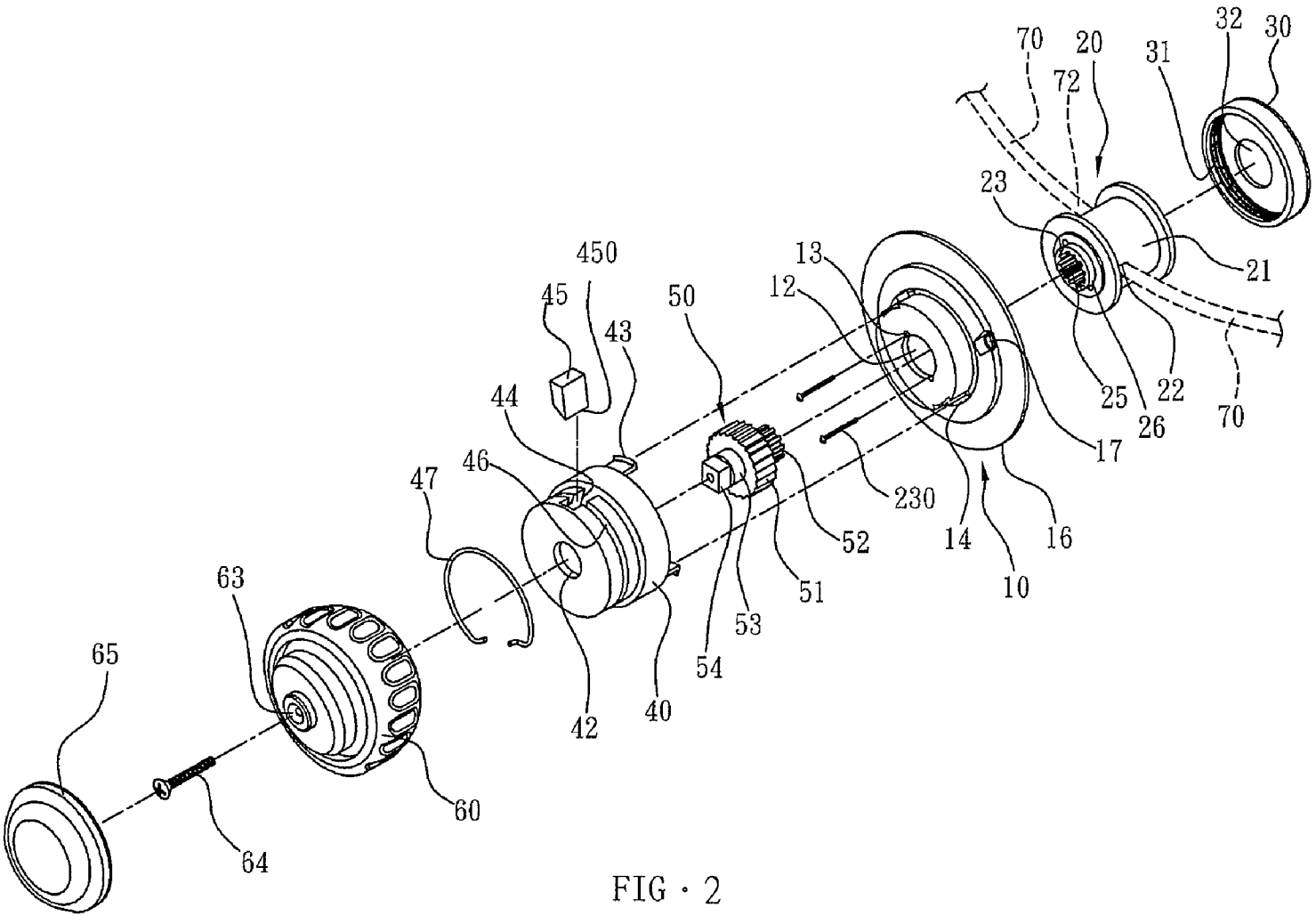
FIG. 2 is an exploded perspective view of the lace winding device as shown in FIG. 1.
Figure 4:
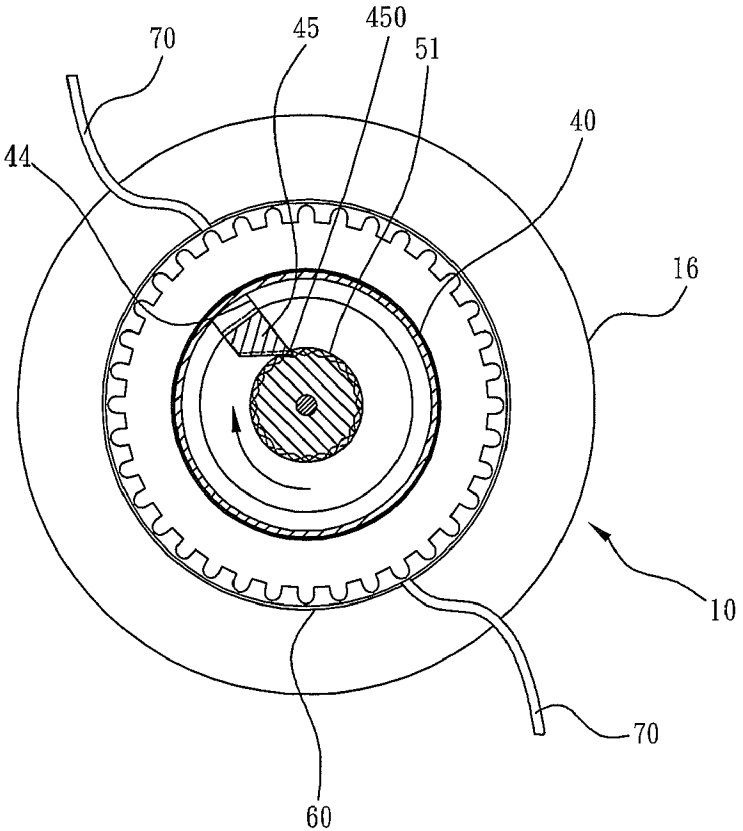
FIG. 4 is a front cross-sectional view of the lace winding device as shown in FIG. 1.
Figure 3:
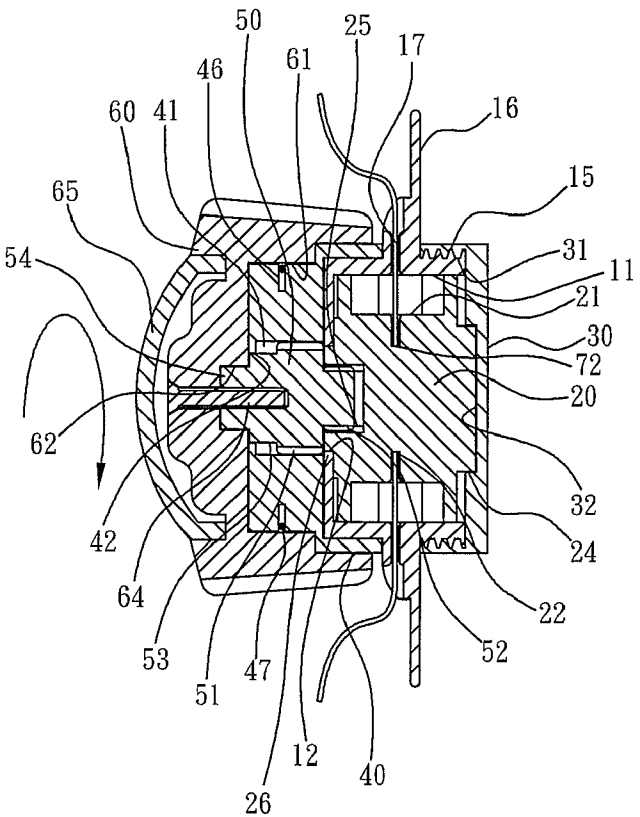
FIG. 3 is a side cross-sectional view of the lace winding device as shown in FIG. 1.
Figure 5:
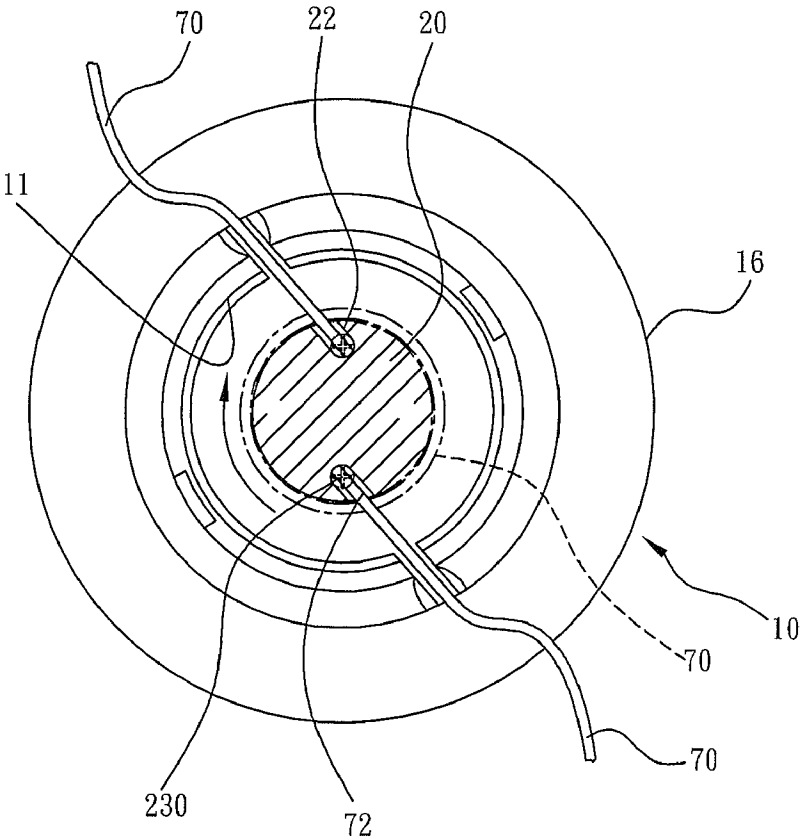
FIG. 5 is another front cross-sectional view of the lace winding device as shown in FIG. 1.
Figure 6:
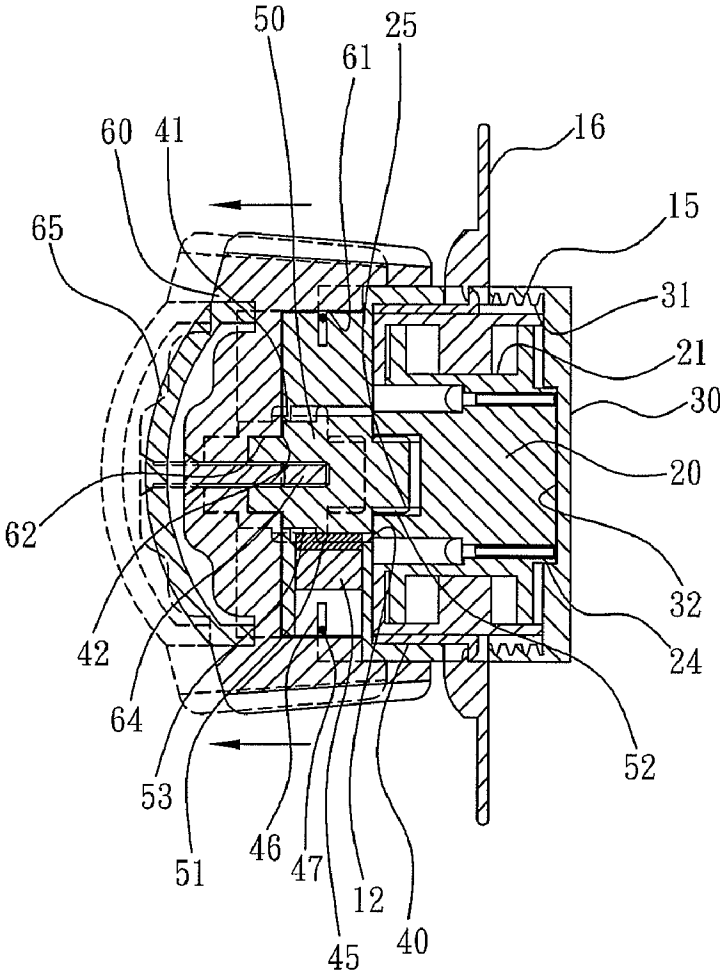
FIG. 6 is a schematic operational view of the lace winding device as shown in FIG. 3.
Figure 7:
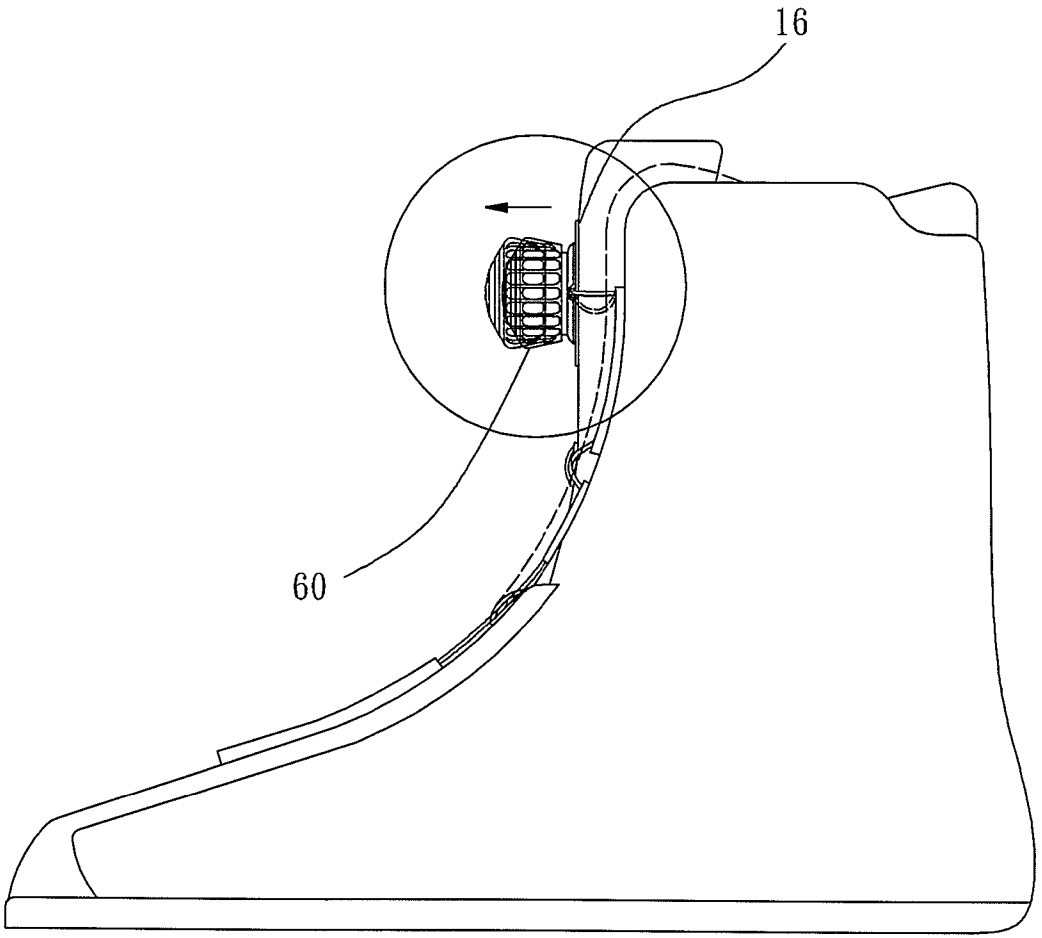
FIG. 7 is a side operational view of the lace winding device as shown in FIG. 1.
Figure 8:
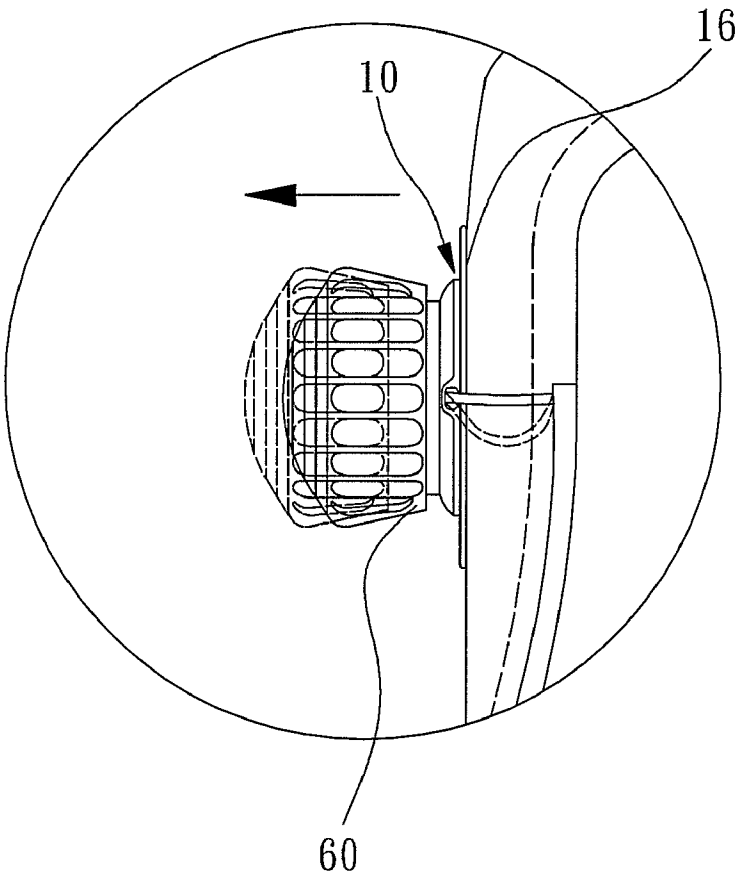
FIG. 8 is a locally enlarged view of the lace winding device as shown in FIG. 7.

In operation, referring to FIGS. 3-8 with reference to FIGS. 1 and 2, when the control knob 60 is pushed toward the limit barrel 40, the drive member 50 is pushed toward the spool 20 so that the keys 52 of the drive member 50 engage the keyways 25 of the spool 20, and the drive member 50 is combined with the spool 20. In such a manner, when the control knob 60 is rotated, the spool 20 is also rotated to wind the lace 70. At this time, the ratchet wheel 51 of the drive member 50 is limited by the locking detent 450 of the ratchet block 45 so that the ratchet wheel 51 of the drive member 50 is rotated in one direction only. Thus, the spool 20 is driven by the drive member 50 to rotate in one direction only so as to wind the lace 70 easily and quickly. On the contrary, when the control knob 60 is pulled outward relative to the limit barrel 40, the drive member 50 is pulled outward relative to the spool 20 so that the keys 52 of the drive member 50 disengage the keyways 25 of the spool 20, and the drive member 50 is detached from the spool 20. In such a manner, the spool 20 can be rotated in the opposite direction to unwind the lace 70.

Figure 9:
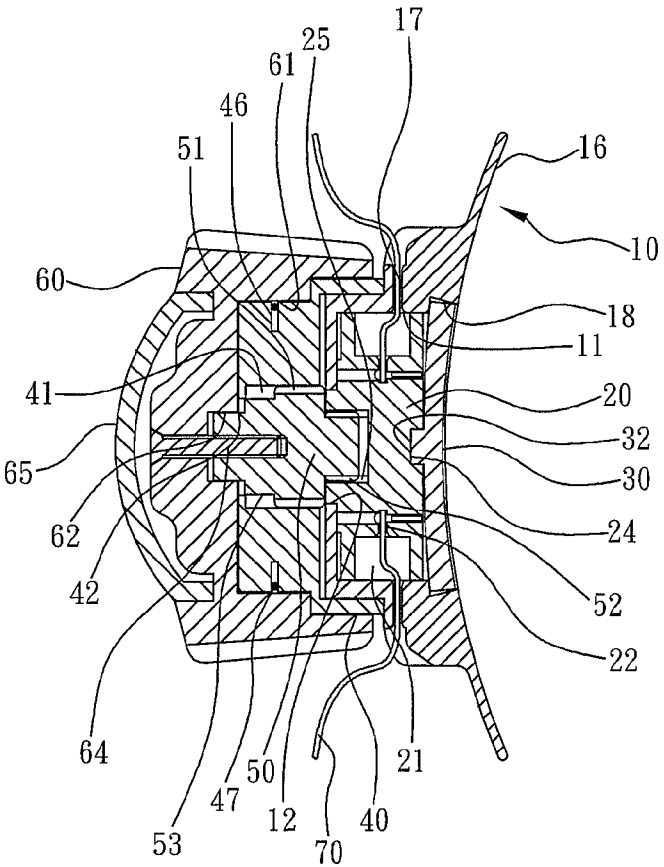
FIG. 9 is a side cross-sectional view of a lace winding device in accordance with another preferred embodiment of the present invention.

As shown in FIG. 9, the mounting ring 16 of the base 10 has a substantially arc-shaped profile and has an inner portion formed with a mounting recess 18 to receive the end cap 30. In addition, the spool 20 has a second side provided with a recessed pivot portion 24, and the end cap 30 has a central portion provided with a protruding pivot section 32 mounted in the pivot portion 24 of the spool 20 so that the pivot portion 24 of the spool 20 is rotatable by support of the pivot section 32 of the end cap 30.

Figure 10:
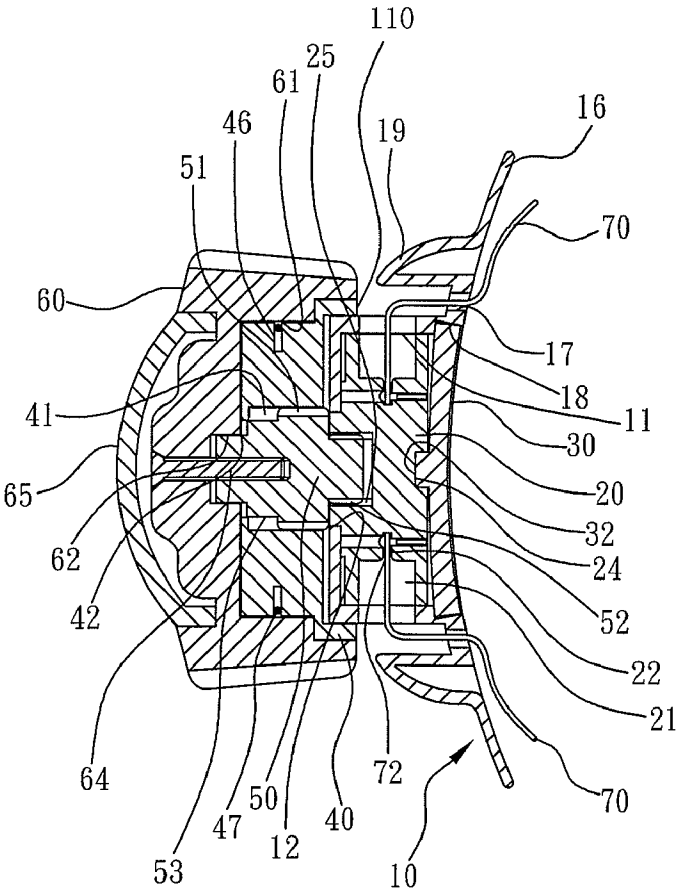
FIG. 10 is a side cross-sectional view of a lace winding device in accordance with another preferred embodiment of the present invention.

As shown in FIG. 10, the base 10 has an open peripheral wall 110 connected to the receiving chamber 11 to allow passage of the two distal ends 72 of the lace 70, and the passages 17 of the base 10 are formed transversely in a peripheral wall of the mounting ring 16 and are connected to the open peripheral wall 110 of the base 10. In addition, the mounting ring 16 has a surface provided with an annular enclosure 19 to shade the open peripheral wall 110 of the base 10.

Accordingly, the ratchet wheel 51 of the drive member 50 is rotated in one direction only by limit of the locking detent 450 of the ratchet block 45 so that the spool 20 is driven by the drive member 50 to rotate in the positive direction only and cannot be rotated in the opposite direction so as to wind the lace 70 easily and quickly, thereby facilitating a user winding the lace 70. In addition, the user only needs to rotate the control knob 60 to wind the lace 70 so that the user can wind the lace 70 by his one hand only so as to operate the lace winding device easily and quickly. Further, the lace 70 is directly locked onto the spool 20 so that the user can wind and unwind the lace 70 easily and conveniently. Further, the lace 70 is wound around the spool 20 so that the lace 70 will not be rubbed or worn out.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lace winding device comprising:

a base;

a spool rotatably mounted in the base;

a lace having two distal ends each extending through the base and each secured on the spool to move in concert with the spool;

a limit barrel mounted on the base;

a drive member rotatably mounted in the limit barrel and connected with the spool to drive and rotate the spool;

a ratchet block movably mounted on the limit barrel and engaging the drive member to limit the drive member to rotate in a oneway manner; and an elastic member mounted on the limit barrel and abutting the ratchet block to press the ratchet block toward the limit barrel, wherein the base has an inner portion formed with a receiving chamber to receive the spool and has a peripheral wall formed with two passages each connected to the receiving chamber to allow passage of each of the two distal ends of the lace;

the spool is rotatably mounted in the receiving chamber of the base and is disposed between the base and an end cap;

the spool has an outer wall formed with a recessed winding zone connected to the receiving chamber of the base to wind and unwind the lace by rotation of the spool;

the spool has an inner wall formed with a plurality of keyways;

the lace is mounted in the winding zone of the spool;

the limit barrel has an inner portion formed with a receiving space to receive the drive member and has a peripheral wall formed with a receiving recess connected to the receiving space to receive the ratchet block;

the ratchet block is movably mounted in the receiving recess of the limit barrel and has a distal end provided with an oblique locking detent extending into the receiving space of the limit barrel and engaging the drive member;

the drive member is rotatably mounted in the receiving space of the limit barrel and is disposed between the limit barrel and the base;

the drive member has a mediate portion provided with a ratchet wheel engaging the locking detent of the ratchet block;

the ratchet wheel of the drive member is limited by the locking detent of the ratchet block so that the ratchet wheel of the drive member is rotatable in the receiving space of the limit barrel in one direction only;

the drive member has a first side provided with a plurality of keys engaging the keyways of the spool;

the drive member has a second side provided with a shaft protruding outward from the limit barrel; and the elastic member presses the locking detent of the ratchet block toward the ratchet wheel of the drive member.

2. The lace winding device of claim 1, wherein the limit barrel has an outer wall formed with an annular retaining groove connected to the receiving recess to receive the elastic member.

3. The lace winding device of claim 1, wherein the base has an outer wall provided with an enlarged mounting ring which extends radially and outwardly.

4. The lace winding device of claim 3, wherein the enlarged mounting ring of the base has a side formed with two locking grooves; and the limit barrel has a side provided with two flexible locking pieces snapped into and locked in the locking grooves of the mounting ring to lock the limit barrel onto the base.

5. The lace winding device of claim 3, wherein the end cap is mounted on the base and abuts the spool to cover the spool; and the mounting ring of the base has a substantially arc-shaped profile and has an inner portion formed with a mounting recess to receive the end cap.

6. The lace winding device of claim 3, wherein the base has an open peripheral wall connected to the receiving chamber to allow passage of the two distal ends of the lace;

the two passages of the base are formed transversely in a peripheral wall of the mounting ring and are connected to the open peripheral wall of the base; and the enlarged mounting ring has a surface provided with an annular enclosure to shade the open peripheral wall of the base.

7. The lace winding device of claim 3, wherein the two passages of the base are formed radially in a peripheral wall of the enlarged mounting ring.

8. The lace winding device of claim 1, wherein the base has an end face formed with a mounting hole connected to the receiving chamber;

the mounting hole of the base is co-axial with and has a diameter smaller than that of the receiving chamber; and the spool has a first side provided with a protruding mounting portion rotatably mounted in the mounting hole of the base.

9. The lace winding device of claim 8, wherein the spool has a second side provided with a protruding pivot portion;

the end cap is mounted on the base and abuts the spool to cover the spool; and the end cap has a central portion provided with a recessed pivot section mounted on the pivot portion of the spool so that the pivot portion of the spool is rotatable by support of the pivot section of the end cap.

10. The lace winding device of claim 8, wherein the spool has a second side provided with a recessed pivot portion;

the end cap is mounted on the base and abuts the spool to cover the spool; and the end cap has a central portion provided with a protruding pivot section mounted in the pivot portion of the spool so that the pivot portion of the spool is rotatable by support of the pivot section of the end cap.

11. The lace winding device of claim 8, wherein the end face of the base has a periphery formed with two fixing bores each connected to the receiving chamber;

the winding zone of the spool has a peripheral wall formed with two tie holes aligning with the two passages of the base to allow entrance of the two distal ends of the lace;

the first side of the spool has a periphery formed with two screw bores connected to the two tie holes and aligning with the two fixing bores of the base;

the two distal ends of the lace extend through the two passages of the base, the receiving chamber of the base and the winding zone of the spool into the two tie holes of the spool; and the lace winding device further comprises two screw members extending through the two fixing bores of the base and screwed into the two screw bores of the spool to press the two distal ends of the lace so as to lock the two distal ends of the lace onto the spool.

12. The lace winding device of claim 1, wherein the limit barrel has an end face formed with a through hole connected to the receiving space;

the through hole of the limit barrel is co-axial with and has a diameter smaller than that of the receiving space; and the shaft of the drive member is rotatably mounted in the through hole of the limit barrel.

13. The lace winding device of claim 12, wherein the shaft of the drive member has a distal end provided with a plug protruding outward from the through hole of the limit barrel;

the drive member is movable axially in the receiving space of the limit barrel and is movable axially relative to the spool;

the lace winding device further comprises a control knob rotatably mounted on the limit barrel and connected with the drive member to move the drive member;

the control knob has an inner portion formed with a sliding recess rotatably mounted on the limit barrel; and the sliding recess of the control knob is movable axially on the limit barrel and has a bottom wall formed with a fixing slot secured on the plug of the drive member to combine the control knob with the drive member so that the drive member is rotatable in concert with the control knob.

14. The lace winding device of claim 13, wherein the control knob has an end face formed with a through bore connected to the fixing slot; and the lace winding device further comprises a fastening bolt extending through the through bore of the control knob and screwed into the plug of the drive member to fasten the control knob with the drive member.

15. The lace winding device of claim 1, wherein the base has a side provided with an outer threaded portion;

the end cap is mounted on the base and abuts the spool to cover the spool;

the receiving chamber of the base is closed by the end cap; and the end cap has a side provided with an inner threaded portion screwed onto the outer threaded portion of the base to lock the end cap onto the base.

* * * * *